US005808637A

United States Patent [19]

Wenzel et al.

[11] Patent Number: 5,808,637

[45] Date of Patent: Sep. 15, 1998

[54] METHOD AND APPARATUS FOR INK DROP TRAJECTORY CONTROL

[75] Inventors: Donald E. Wenzel, Albany; David E. Hackleman, Monmouth, both of Oreg.

[73] Assignee: Hewlett-Packard Company, Palo Alto, Calif.

[21] Appl. No.: 451,788

[22] Filed: May 26, 1995

[51] Int. Cl.[6] ..... B41J 2/11

[52] U.S. Cl. ..... 347/53; 347/55

[58] Field of Search ..... 347/53, 55; 106/20 D, 106/31.92

[56] References Cited

U.S. PATENT DOCUMENTS

| | | | |
|---|---|---|---|
| 4,258,371 | 3/1981 | Sekine | 347/53 |
| 4,336,546 | 6/1982 | Edwards et al. | 347/53 |
| 4,359,752 | 11/1982 | Nakagawa et al. | 347/53 |
| 4,928,125 | 5/1990 | Iino | 347/53 |
| 5,382,963 | 1/1995 | Ponds et al. | 347/53 |

FOREIGN PATENT DOCUMENTS

| | | | |
|---|---|---|---|
| 0147225 | 10/1962 | U.S.S.R. | 347/53 |

OTHER PUBLICATIONS

"Laser–Compatible Inkjet Text Printing", by Bohorquez et al., Hewlett Packard Journal, dated Feb. 1994, pp. 9–17.

*Primary Examiner*—Valerie Lund

[57] ABSTRACT

A ferromagnetic ink is formed by a dispersion of ferromagnetic particles mixed with an ink base. Drops of the ink are ejected from an inkjet printhead to print characters or markings onto a print media sheet. To resist clogging printhead nozzles, the dispersed ferromagnetic particles have an average diameter equal to or less than approximately 1/10 of the average nozzle diameter. A magnetic field is applied to the ejected ink drops during printing to direct, or more specifically bias, the ink drops toward the print media. The magnetic "biasing" force aids in maintaining drop shape along the ejection path, and in reducing bounce. As a result, edge roughness and spray are decreased so as to improve print quality. In alternative embodiments, the magnetic field source is formed by a permanent magnet or electromagnet. Such a field source is integral to or adjacent to a printer platen. The field source is located adjacent to the printhead and in several embodiments extends along the scan path of the printhead. In one embodiment the field source is formed on the ink cartridge.

14 Claims, 4 Drawing Sheets

METHOD AND APPARATUS FOR INK DROP TRAJECTORY CONTROL

BACKGROUND OF THE INVENTION

This invention relates generally to inkjet printing methods and apparatus, and more particularly to a ferromagnetic inkjet ink and the method and apparatus for controlling the print trajectory of such ink.

In the field of inkjet printing, ink is delivered under pressure to a printhead's nozzle area. According to one method, the ink is heated causing a vapor bubble to form in a nozzle which then ejects the ink as a droplet. Droplets are ejected from respective nozzles to effectively imprint characters and graphic markings onto a printout. Typical inkjet inks are water-based with pigments or dyes added for coloration.

The quality of the resulting print markings is typically characterized based on hue, darkness, edge roughness, edge contrast, presence of artifacts, and uniformity of area fills. Minimizing edge roughness and the presence of artifacts, such as via ink spray, have been troublesome problems for inkjet printing. To minimize such problems the dot ejection process is designed to generate drops at a repeatable velocity and volume. A description of the drop generation process and the methods of controlling drop size, shape and volume distribution for the Hewlett-Packard DESKJET® 1200C printer is described in "Laser-Compatible Inkjet Text Printing," by Bohorquez et al., *Hewlett Packard Journal*, February 1994. Ideally the ejected drop stays together in a uniform repeatable shape and lands on target. As print speeds increase, however, the problem of keeping the dot together and uniform becomes more difficult. Accordingly, there is a need for an improved print trajectory control process for inkjet printing.

SUMMARY OF THE INVENTION

According to the invention, a ferromagnetic ink is used for printing within a magnetic field. The field biases the ink drop along its path as it is ejected from a printhead nozzle toward a print media.

According to one aspect of the invention, an aqueous colloidal solution of ferromagnetic material is added to a conventional dye or pigment based ink to form the ferromagnetic ink. To avoid clogging the inkjet printhead nozzles, the ferromagnetic material is a fine particulate having a diameter substantially less than the nozzle diameter. Preferably, the ferromagnetic material has an average diameter less than 1/50 the nozzle diameter. In a best mode embodiment the ferromagnetic material diameter is approximately 1/4000 to 1/1000 the nozzle diameter. In a specific embodiment ferromagnetic particles with an average diameter of approximately 100 angstroms are dispersed in an ink and ejected through nozzles having a diameter of 10–50 microns.

According to another aspect of the invention, the field is created in the vicinity of the inkjet printhead. The field acts upon the magnetic attributes of an ejected drop to bias the drop toward a print media (e.g., paper, transparency, film). The forces aid in maintaining the drop shape and direct the drop to a target location on the print media.

According to another aspect of the invention, a print media platen includes a field source for generating a magnetic or electromagnetic field. In alternative embodiments, a permanent magnet or electromagnet is integral to or positioned adjacent to the platen. The resulting field acts upon the ferromagnetic ink to bias the ink shape and trajectory path.

According to another aspect of the invention, the biasing field occurs along the scan path of the inkjet printhead. Typically, a print media moves relative to a printhead in a first plane (e.g., xy plane) while the printhead scans along an axis (e.g., x axis). Thus, the printhead moves in a line along a single axis. The biasing field occurs along such scan line.

One advantage of the invention is that drop shape and trajectory are controlled so as to reduce edge roughness and ink spray. As a result, inkjet print quality is improved. As inkjet technology advances to use smaller sized drops such control will be even more beneficial and desirable.

These and other aspects and advantages of the invention will be better understood by reference to the following detailed description taken in conjunction with the accompanying drawings.

DESCRIPTION OF SPECIFIC EMBODIMENTS

Overview

Figure 1:
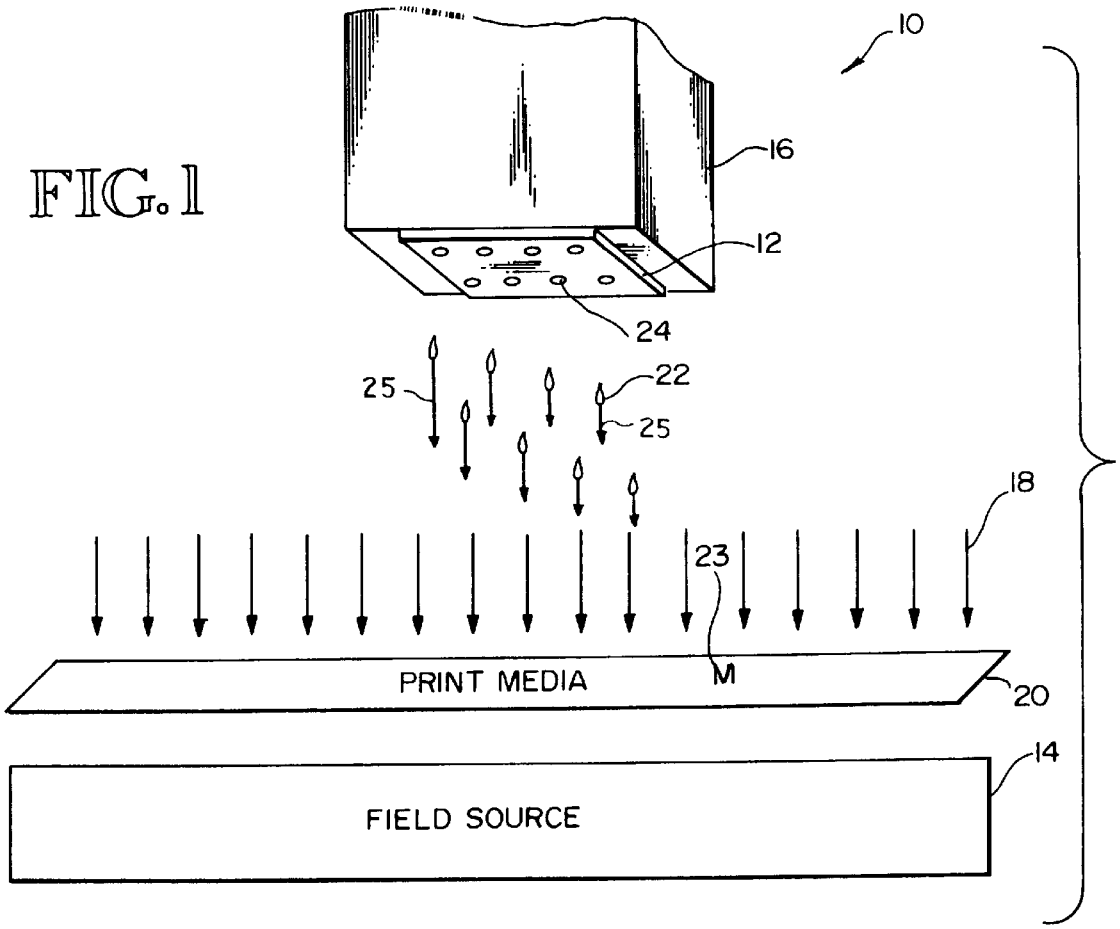
FIG. 1 is a diagram of an inkjet trajectory control apparatus according to an embodiment of this invention.

FIG. 1 shows an inkjet print trajectory control apparatus 10 according to an embodiment of this invention. The apparatus includes an inkjet printhead 12 and a biasing field source 14. The printhead 12 is mounted to a printer cartridge 16 which stores a supply of ink. According to an aspect of the invention the ink is a ferromagnetic ink which reacts to a biasing field 18. During a print operation, print media 20 is fed adjacent to the printhead 12. Inkjet drops 22 are ejected from respective nozzles 24 toward the print media 20. With the field source 14 active, the biasing field 18 provides additional forces on the ink drops 22 to direct the drops to the print media. Preferably the biasing field creates an attractive force in a perpendicular direction between a plane of the field source 14 and a parallel plane of the printhead 12. The downward force on the drops also aid in keeping each drop whole as it falls, so as to avoid undesirable ink drop spray. Further, the biasing forces encourage the drops 22 to fall accurately to desired target points on the print media 20.

For the ink drops 22 to be influenced by the biasing field 18, the ink includes ferromagnetic material. In alternative embodiments the biasing field 18 is formed by permanent magnet(s) (see FIG. 3), an electromagnet (see FIGS. 4–6) or an electrostatic actuator.

Ferromagnetic Ink

The ferromagnetic ink 22 is formed by including ferromagnetic particulate in an ink. Exemplary ink bases include pigment or dye, solvents and water. A suspension of finely divided ferromagnetic particles in a continuous medium, such as a colloidal solution, is mixed with the ink base to achieve the ferromagnetic ink. The ferromagnetic particles average between 5 and 5000 angstroms in diameter. In a preferred embodiment, the ferromagnetic particles have an average diameter of approximately 100 angstroms and range between 50 and 200 angstroms in diameter. As the conventional inkjet nozzle is approximately 10–50 microns in diameter, the particles average 50–2000 times smaller than the nozzle diameter. As technology evolves the nozzle size will be smaller. Preferably, the average particle diameter is less than one-fiftieth (1/50) the diameter of the nozzles, (e.g., less than 500 Angstroms).

In a specific embodiment the colloidal solution is a dispersed ferromagnetic iron lignosulfonate. The solution has a high molecular weight as characteristic of lignosulfonate and an x-ray diffraction pattern as typical of the dispersed ferromagnetic particles. An exemplary solution is sold by the Georgia Pacific Corp. of Bellingham, Wash. under the name LIGNOSITE FML. The solution is a thermodynamically stable aqueous colloidal dispersion of ferromagnetic iron in lignosulfonate. The dispersion does not exhibit significant settling out, even upon standing for prolonged periods. The solution can be dried and redissolved without separation of the iron from the lignosulfonate and without losing the magnetic properties. Such characteristics occur because the lignosulfonate is firmly attached to the magnetic particles by chemical bonds and is not separable by non-destructive chemical processes.

The LIGNOSITE FML solution is sold as dark drown liquid of approximately 32% solids and a Brookfield viscosity of 29 cps at 25° C. In a working embodiment the LIGNOSITE FML is mixed a black pigment ink base at a ratio of 1 part solution to 2 parts conventional black pigment ink base. For a black ink, in one embodiment a carbon black pigment base ink is used. An exemplary embodiment of such base has a viscosity of 4.6 cps at 25° C. and a surface tension of 55.9 dynes/cm. The ink has a calculated saturization magnetization of 30 Gauss and an iron content of approximately 3%.

Trajectory Control Apparatus Embodiments

Figure 2:
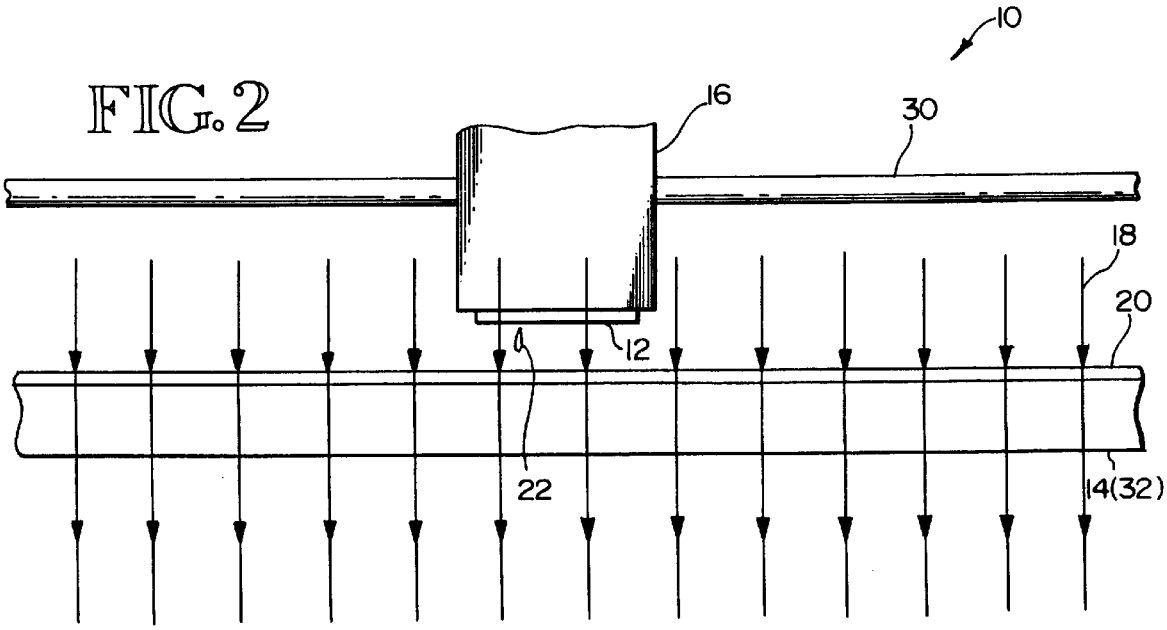
FIG. 2 is an alternative view of the apparatus of FIG. 1.

FIG. 2 shows the trajectory control apparatus 10 according to a inkjet scanning-cartridge embodiment of this invention. A printhead 12 is part of an inkjet scanning cartridge 16 which moves along a rail 30 to scan laterally across a print media sheet 20. The media sheet 20 is fed along a print platen 32 with a portion of the sheet 20 adjacent to the printhead 12 receiving ink 22. The ink 22 is ferromagnetic and exposed to a magnetic field 18 for biasing the ink toward the print media 20. The magnetic field is created by a field source 14.

Figure 3:
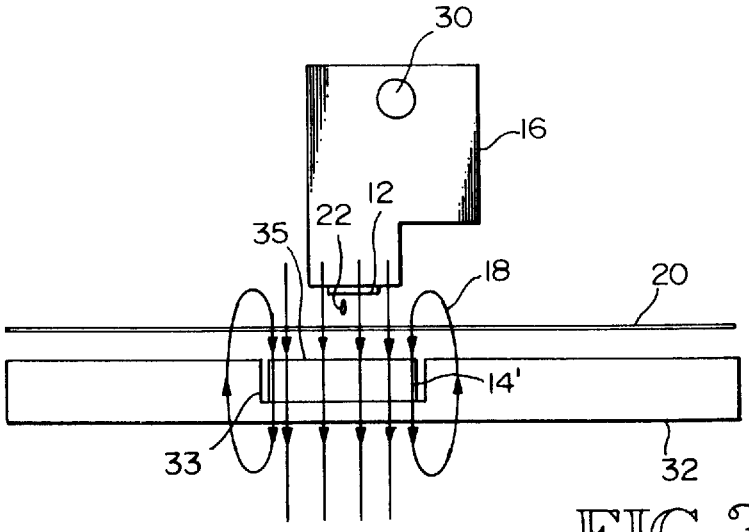
FIG. 3 is a side view of an inkjet trajectory control apparatus embodiment having a permanent magnet for generating a magnetic field.

FIG. 3 shows an embodiment in which the field source 14 is formed by one or more permanent magnets 14'. The magnets 14' are positioned laterally across the platen 32 in a recessed area 33. The magnets 14' are positioned along the scan line of the inkjet cartridge 16. Spacings among the printhead 12, print media 20, platen 32 and magnets 14' are exaggerated for purposes of illustration. Preferably the magnets 14' are wide enough (along a longitudinal direction of the platen) so that magnetic field flux lines extending between an anterior surface 35 of the magnets 14' and the printhead 12 surface are (i) perpendicular to the printhead 12 and magnets 14', and (ii) parallel to each other—as shown. Permanent magnets creating a field strength of at least 30 Gauss at a distance of approximately 1 mm from the anterior surface 35 provide noticeable trajectory control improvement for the exemplary ferromagnetic ink embodiment having a saturization magnetization of approximately 30 Gauss. Preferably the magnetic field strength is approximately 100 Gauss at a distance of 1 mm from anterior surface 35.

FIGS. 4–7 show alternative embodiments in which an electro-magnet 14" creates the biasing field 18. In FIGS. 1–7 like parts are given like numbers. Further, spacings among components are exaggerated for purposes of illustration. The electromagnet 14" is positioned laterally across the platen 32 in a recessed area 33. Specifically, the electromagnet 14" is positioned along the scan line of the inkjet cartridge 16. Preferably the electromagnet 14" is wide enough (along a longitudinal direction of the platen 32) so that magnetic field flux lines extending between an anterior surface 35 of the electromagnet 14" and the printhead 12 surface are (i) perpendicular to the printhead 12 and electromagnet 14", and (ii) parallel to each other—as shown.

The electromagnet 14" is formed by a conductive center portion surrounded by a coil 36. Terminal of the coil 36 are connected to a power source 37 to define an electrical circuit 38. When the coil 36 is active, the electromagnet 14" generates the biasing field 18. In various embodiments a field strength of at least 30 Gauss at the printhead—(e.g., a distance of approximately 1 mm from the anterior surface 35) is created. Preferably the field strength is approximately 100 Gauss at the 1 mm distance.

Figure 4:
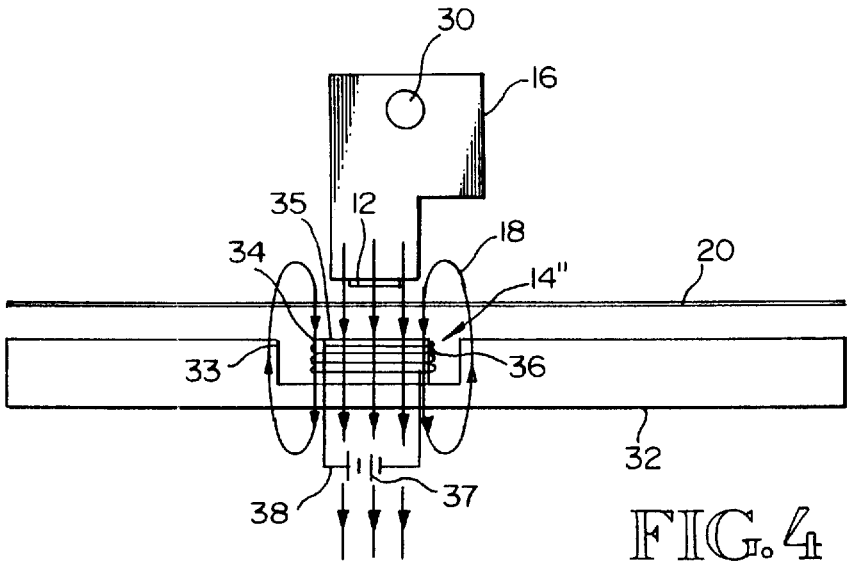
FIG. 4 is a side view of an inkjet trajectory control apparatus embodiment having an electromagnet for generating a magnetic field.
Figure 5:
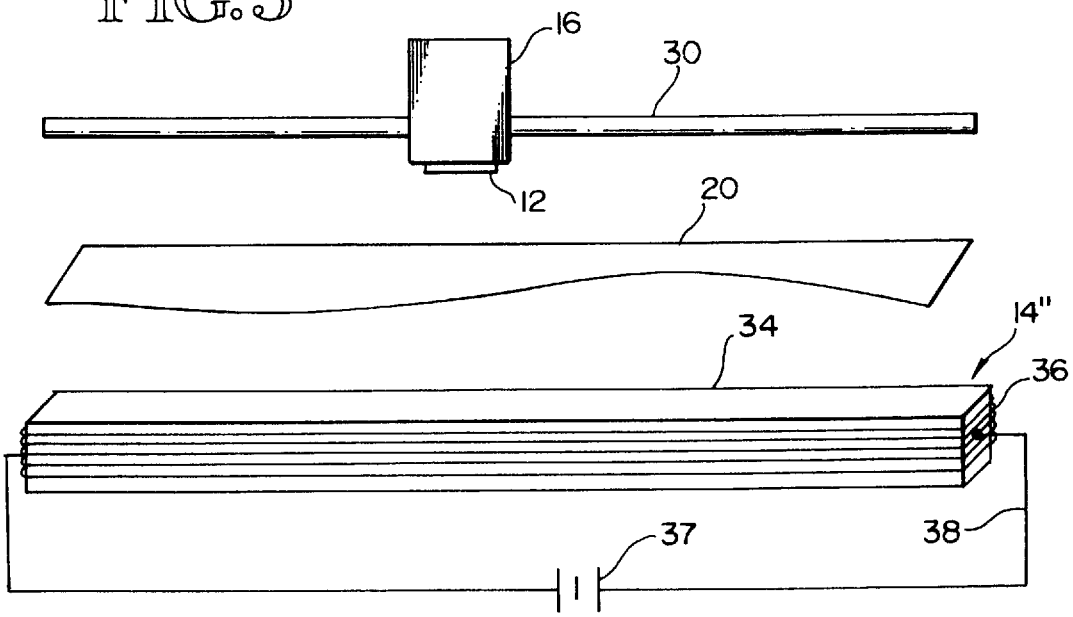
FIG. 5 is a front view of parts of the apparatus of FIG. 4.
Figure 6:
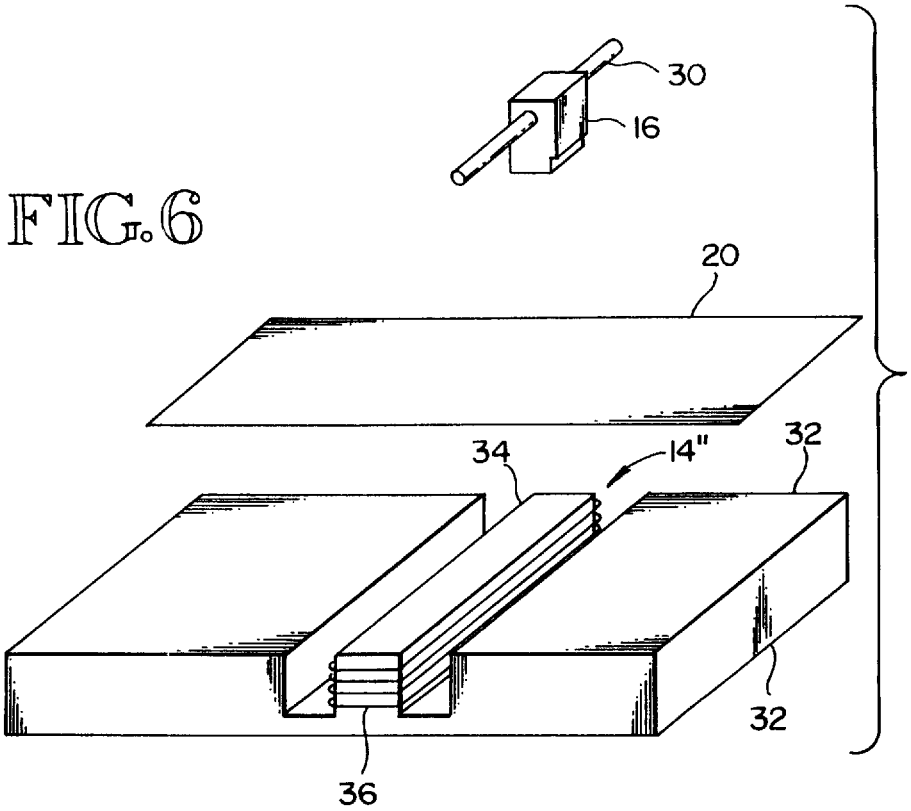
FIG. 6 is an exploded view of an inkjet trajectory control apparatus embodiment having an electromagnet built into the print platen.
Figure 7:
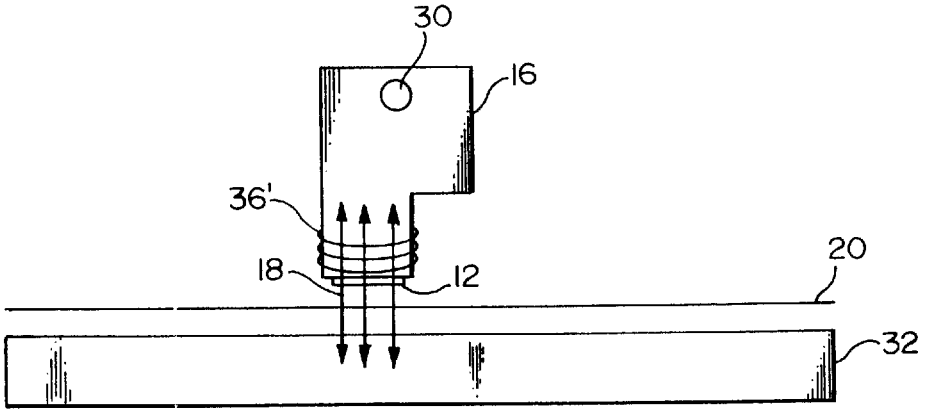
FIG. 7 is a side view of an inkjet trajectory control apparatus embodiment having an electromagnet for generating a magnetic field.

In the embodiments of FIGS. 4–6 the electromagnet is located at or adjacent to the print platen 32. In the embodiment of FIG. 7 the electromagnet is formed on the ink cartridge 16. Specifically a coil 36' is wound about the cartridge 16 to create the biasing field 18.

Trajectory Control Method

In operation the cartridge 16 scans laterally across the print media 20 and platen 32 ejecting ferromagnetic ink to target spots on the print media 20. The magnetic field 18 generates a biasing force on the ink 22, attracting the ink toward the field source 14. As the print media is between the ink 22 and field source the ink is attracted to the print media 20. Because the magnetic flux lines are substantially perpendicular to the plane of the print media 20, the biasing force attracts the ink 22 along a generally straight line 25. Further, the biasing force tends to hold each ink drop together. Thus, the ink drop is better able to retain a repeatable shape and resist spreading or breaking apart. Further upon impact, the ink is attracted to the page and resists bouncing off the print media 20. Thus, the ferromagnetic ink 22 resists spraying.

For a ferromagnetic ink characterized as having a calculated saturization magnetization of 30 Gauss, an iron content of 3% by weight, viscosity of 4.6 cps at 25° C. and a surface tension of 55.9 dynes/cm, a magnetic field strength of approximately 100 Gauss causes noticeable improvement in print quality.

For a test sample printing at 3600 Hz, the following improvement was observed with and without a magnetic field:

| | With Field | Without Field |
|---|---|---|
| Average edge roughness: | 2.77 | 3.07 |
| Total spray | 0.45 | 0.50 |

Such values are in microns and represent a 10 character average. The lower the value the better the performance.

According to an application of the control method ferromagnetic ink characters 23 are generated on print media 20 (see FIG. 1).

Meritorious and Advantageous Effects

This invention addresses the problems of spray and edge roughness in inkjet printing operations. To minimize such problems ferromagnetic ink is used for printing and a magnetic field is applied to the trajectory path 25 to attract ink drops to the print media. The magnetic force holds respective drops together. As a result, edge roughness and spray are improved.

A meritorious effect of the invention is that smaller size drops can be used and/or faster print speeds to maintain acceptable print quality.

Although a preferred embodiment of the invention has been illustrated and described, various alternatives, modifications and equivalents may be used. For example, although iron is the exemplary material described, other ferromagnetic material, including but not limited to cobalt or nickel may be used. Also, the specific saturization magnetization, density and viscosity properties of the ink may vary. Also, the field strength imposed may vary. Alternative configurations include having the field source scan beneath the print media tracking the scan path of the inkjet cartridge. For a page-wide array ("PWA") inkjet printhead embodiment of this invention, the field source spans at least the length of the PWA nozzle area. Therefore, the foregoing description should not be taken as limiting the scope of the inventions which are defined by the appended claims.

What is claimed is:

1. An apparatus for controlling the print trajectory of inkjet ink, comprising:

ferromagnetic ink;

an inkjet printhead having a plurality of printing elements, each printing element receiving ink and heating the received ink to form a vapor bubble which ejects the received ink as a respective ferromagnetic ink drop along a trajectory path; and a magnetic field source which generates a permanent magnetic field occurring in the paths of the respective ejected ink drops to bias the ejected ink drops along a path toward a print media.

2. The apparatus of claim 1, in which the magnetic field source comprises either one of a permanent magnet or an electromagnet.

3. The apparatus of claim 1, in which the ferromagnetic ink comprises an ink base and a thermodynamically stable colloidal solution of ferromagnetic particles.

4. The apparatus of claim 3, in which the colloidal solution comprises ferromagnetic particles dispersed in lignosulfonate.

5. The apparatus of claim 3, in which the ferromagnetic particles have an average diameter of less than or equal to approximately 200 angstroms.

6. The apparatus of claim 3, in which the ferromagnetic ink has a saturization magnetization of at least approximately 25 Gauss, and the magnetic field has a strength of at least approximately 30 Gauss at the printhead.

7. The apparatus of claim 3, in which the ferromagnetic ink has a ferromagnetic particle content of approximately 1% to 5% by weight.

8. A method for controlling print trajectory of inkjet ink, comprising the steps of:

generating a magnetic field having flux lines extending between a media sheet and an inkjet printhead;

heating ink within a plurality of printing elements of the printhead;

forming a respective vapor bubble within each of the plurality of printing elements in response to the step of heating;

ejecting a ferromagnetic ink drop from each of the plurality of printing elements under expansion forces of the respective vapor bubbles, wherein a plurality of ink drops are ejected along respective trajectory paths toward the print media;

biasing with the magnetic field the ejected plurality of ink drops along respective straight line paths toward the print media; and repeating the steps of heating, forming and biasing for multiple cycles without discontinuing the magnetic field between cycles.

9. The method of claim 8, in which the magnetic field is substantially parallel to the trajectory path.

10. The method of claim 8, in which the ferromagnetic ink comprises an ink base and a thermodynamically stable colloidal solution of ferromagnetic particles.

11. The method of claim 8, in which the magnetic field is generated by a permanent magnet.

12. The method of claim 8, in which the magnetic field is generated by an electromagnet.

13. An apparatus for controlling the print trajectory of inkjet ink, comprising:

ferromagnetic ink;

an inkjet printhead having a plurality of printing elements, each printing element receiving ink and heating the received ink to form a vapor bubble which ejects the received ink as a respective ferromagnetic ink drop along a trajectory path; and a magnetic field source which generates a permanent magnetic field occurring in the paths of the respective ejected ink drops to hold each respective ink drop together, to bias the ejected ink drops along a straight path toward a print media, and to reduce bounce of ink off the print media.

14. A method for controlling print trajectory of inkjet ink, comprising the steps of:

generating with a permanent magnet a magnetic field having flux lines extending between the permanent magnet and an inkjet printhead;

heating ink within a plurality of printing elements of the printhead;

forming a respective vapor bubble within each of the plurality of printing elements in response to the step of heating;

ejecting a ferromagnetic ink drop from each of the plurality of printing elements under expansion forces of the respective vapor bubbles, wherein a plurality of ink drops are ejected along respective trajectory paths toward the print media;

biasing with the magnetic field the ejected plurality of ink drops along respective paths toward the print media; and repeating the steps of heating, forming and biasing for multiple cycles.

* * * * *